US006634205B2

(12) United States Patent
Yashima et al.

(10) Patent No.: US 6,634,205 B2
(45) Date of Patent: Oct. 21, 2003

(54) HYDRAULIC CONTROL METHOD FOR HYDRAULIC PRESS

(75) Inventors: Tsuneaki Yashima, Akashi (JP); Kikuo Uchida, Akashi (JP); Nobuyuki Nagayasu, Akashi (JP)

(73) Assignee: Kawasaki Hydromechanics Corporation, Akashi (JP)

( * ) Notice: Subject to any disclaimer, the term of this patent is extended or adjusted under 35 U.S.C. 154(b) by 32 days.

(21) Appl. No.: 09/993,625

(22) Filed: Nov. 27, 2001

(65) Prior Publication Data

US 2002/0062676 A1 May 30, 2002

(30) Foreign Application Priority Data

Nov. 30, 2000 (JP) ..... 2000-365491

(51) Int. Cl.[7] ..... B30B 1/34; B30B 15/02; B21J 9/20; B21J 7/28

(52) U.S. Cl. ..... 72/443; 72/453.07; 72/453.08; 72/453.02; 100/269.06

(58) Field of Search ..... 72/453.01, 453.05, 72/453.06, 453.07, 453.08, 443; 100/269.06

(56) References Cited

U.S. PATENT DOCUMENTS 3,343,217 A * 9/1967 Daubenberger ..... 72/453.06
3,835,682 A * 9/1974 Elger ..... 72/453.08
4,125,010 A * 11/1978 Adam ..... 72/453.08
5,379,628 A * 1/1995 Pahnke et al. ..... 72/453.01
5,473,926 A * 12/1995 Futamura et al. ..... 72/453.07
5,568,766 A * 10/1996 Otremba et al. ..... 72/453.01
5,634,398 A * 6/1997 McGee et al. ..... 72/453.05
5,735,201 A * 4/1998 Hirao et al. ..... 72/453.07
6,253,672 B1 * 7/2001 Rauf et al. ..... 72/453.06

* cited by examiner

*Primary Examiner*—David B. Jones
(74) *Attorney, Agent, or Firm*—Birch, Stewart, Kolasch & Birch, LLP

(57) ABSTRACT

A tryout of a metal mold for a mechanical press suitable for mass production is carried out with a hydraulic press in accordance with the same motion curve as that of the mechanical press so as to reduce metal mold corrections at a job site as much as possible. When trial molding is carried out, an adequate amount of oil capable of obtaining a press motion curve of the mechanical press in accumulators is accumulated so that a predetermined amount of oil can be supplied to a plurality of pressing cylinders of the hydraulic press, hydraulic oil selectively is supplied to a predetermined pressure cylinder of a plurality of pressure cylinders and hydraulic control is applied to the pressure cylinders by a servo valve so as to obtain a coincidence with a press motion curve of a mechanical press with predetermined output.

10 Claims, 4 Drawing Sheets

HYDRAULIC CONTROL METHOD FOR HYDRAULIC PRESS

BACKGROUND OF THE INVENTION

This invention relates to a hydraulic control method for a trial hydraulic press in the press industrial field, in which a tryout of a metal mold for a mechanical press suitable for mass production is carried out with a hydraulic press in accordance with the same motion curve as that of the mechanical press so as to reduce metal mold corrections at a job site as much as possible.

Many of small-sized to large-sized goods on the market are produced by press molding. A so-called mechanical press, such as a link press, a crank press, or an eccentric press, is used especially for mass production by press molding.

In order to manufacture or correct a metal mold for such goods, it is preferable to use the same mechanical press as a press used in actual production, but a hydraulic type trial press has been used because the mechanical press is expensive or the mechanical press cannot be easily operated when the metal mold is corrected.

However, when the metal mold that has been manufactured or corrected with the conventional hydraulic type trial press is attached to the mechanical press for molding, the cases frequently occur in which a part of the molding materials is damaged or a molded article cannot have a uniform thickness, so that molding cannot be satisfactorily carried out. For this reason, the metal mold is corrected by shifting between the trial press and the mechanical press. However, this entails much labor and time for correcting the metal mold.

This cause can be ascribed to the difference in speed between the slide of the oil hydraulic press and the slide of the mechanical press, and therefore the press motion curve of the hydraulic press is required to coincide with the press motion curve of the mechanical press.

The present applicant researched and developed a method to achieve a tryout of the metal mold by the hydraulic control so that the slide of the hydraulic press matches the processing speed of the mechanical press. As a result, a great improvement has been brought about, but there still exists a problem in furthering improvements to coincide with a press motion curve peculiar to each individual mechanical press.

Additionally, in recent years, materials that are difficult to mold, such as high tensile steels or aluminum materials, have appeared, and therefore a press of which a metal mold can be easily manufactured and corrected has been demanded.

SUMMARY OF THE INVENTION

The present invention is devised in the light of the above background, and to solve the above problems. It is therefore an object of thereof to provide a hydraulic control method for a trial hydraulic press in which a plurality of pressure cylinders with necessary output are disposed in parallel or axisymmetrically so that a metal mold for a mechanical press can be manufactured and corrected, an adequate amount of oil capable of obtaining a press motion curve of the mechanical press in accumulators is accumulated so that a predetermined amount of oil can be supplied to a plurality of pressure cylinders of the hydraulic press when trial molding is carried out, each directional control valve to an oil supply circuit thereof is connected so that hydraulic oil can be selectively supplied to a plurality of pressure cylinders that have been disposed in parallel or axisymmetrically, a servo valve is disposed so as to freely adjust the amount of oil, hydraulic oil is supplied to a predetermined cylinder of a plurality of pressure cylinders by opening a predetermined directional control valve, and the pressure cylinders are hydraulically controlled by the servo valve so as to obtain a coincidence with a press motion curve of the mechanical press with predetermined output.

Thereby, even in the hydraulic press, a metal mold used in the mechanical press is manufactured, corrected, and tried such that an accumulator is pre-filled with adequate hydraulic oil, and a slide is subjected to hydraulic control so as to match the press motion curve of the mechanical press with predetermined output. Therefore, reciprocative corrections of the metal mold between the hydraulic press and the mechanical press for production can be reduced as much as possible.

Especially, hydraulic oil is supplied to a predetermined pressure cylinder of a plurality of pressure cylinders that have been disposed in parallel or axisymmetrically, and thereby the slide speed can be obtained so as to coincide with the press motion curve of the mechanical press with predetermined output.

For example, hydraulic oil is concentrated on pressure cylinders disposed at the center side of a plurality of pressure cylinders, or hydraulic oil is supplied to pressure cylinders disposed on both sides thereof, and thereby the high slide speed of the mechanical press can be obtained so as to coincide with the press motion curve of the mechanical press with predetermined output.

It is another object of the present invention to provide a hydraulic control method for a trial hydraulic press in which a coincidence is obtained with a predetermined press motion curve of a mechanical press ranging from a start position of a pressing stroke of a slide of the hydraulic press to the lower limit position thereof.

Thereby, it becomes easy to obtain a coincidence with the press motion curve of the mechanical press with predetermined output for the above-mentioned hydraulic press.

It is still another object of the present invention to provide a hydraulic control method for a trial hydraulic press in which a pressure cylinder is subjected to control by means of a servo valve so as to obtain a coincidence with a slide speed at each position of a slide on the basis of a press motion curve of the mechanical press serving as a crank press, an eccentric press, a link press, a toggle press, or a combination of these presses.

Thereby, even in a mechanical press, such as a crank press, an eccentric press, a link press, a toggle press, or a combination of these presses, it becomes easy to obtain a coincidence with a press motion curve with predetermined output that corresponds thereto, and the corrections of the metal mold can be reduced as much as possible.

Further scope of applicability of the present invention will become apparent from the detailed description given hereinafter.

DETAILED DESCRIPTION OF THE PREFERRED EMBODIMENT

Figure 1:
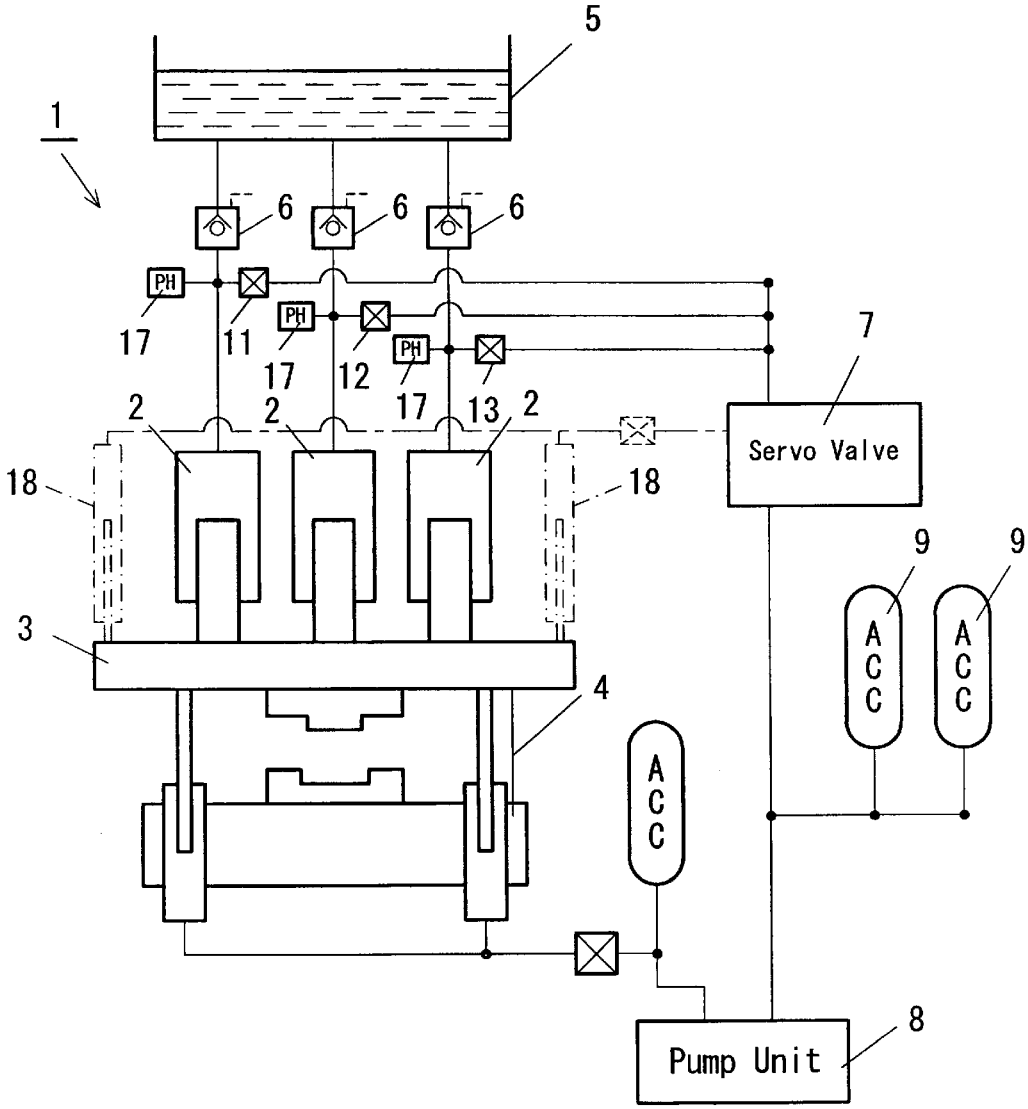
FIG. 1 is a schematic diagram of a press and a hydraulic circuit, with certain parts omitted, according to an embodiment of the present invention.

In a hydraulic press 1 of the present invention, a plurality of pressure cylinders 2 (if possible, an odd number of pressure cylinders) are disposed at a crown(not shown) in parallel or axisymmetrically as shown in FIG. 1, and a slide 3 is designed to obtain a necessary press motion curve by predetermined position control and speed control through a position detector 4.

An hydraulic circuit of the hydraulic press 1 is constructed such that, as shown in FIG. 1, an oil tank 5 is disposed on the crown in the same way as in the conventional one and is connected to each pressure cylinder 2 through pilot operated prefill valves 6 so as to be filled with hydraulic oil.

Each pressure cylinder 2 is further connected to a hydraulic pump unit 8 through a servo valve 7 as shown in FIG. 1, and is connected to a plurality of accumulators 9 with a necessary capacity through the servo valve 7 so that hydraulic oil with predetermined pressure can be supplied to the pressure cylinder 2.

The accumulators 9 have a capacity capable of supplying oil required for press molding by driving the pressure cylinder 2 at high speed in cooperation with the hydraulic pump unit 8, and each directional control valve 11, 12, and 13 is connected to the head side of each pressure cylinder 2 as shown in FIG. 1, and, by properly switching the directional control valves 11, 12, and 13, the hydraulic oil is selectively supplied to a predetermined cylinder of a plurality of pressure cylinders 2 or to another of the pressure cylinders 2 so as to obtain a coincidence with a press motion curve of a mechanical press with necessary output.

Figure 4:
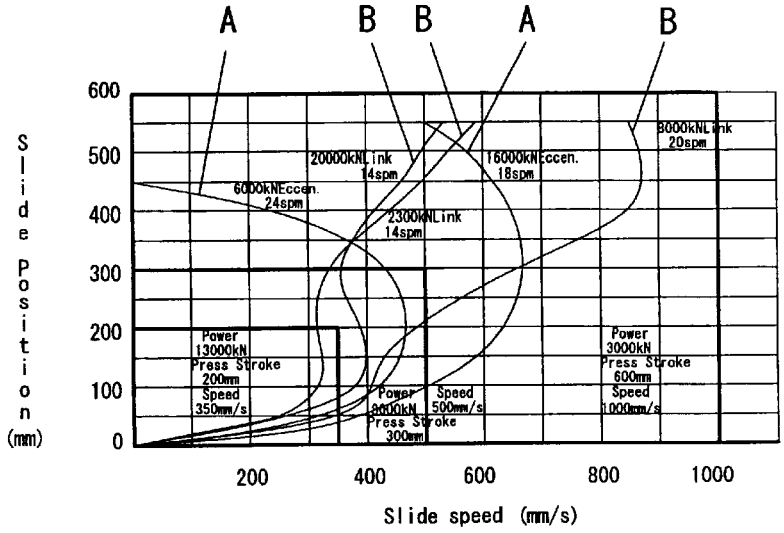
FIG. 4 is an example of a slide position-speed diagram.

For example, when the directional control valves 11 and 13 connected to the head sides of the pressure cylinders 2 on both sides are switched to be blocked, and, as a result, hydraulic oil is concentrated on the pressure cylinder 2 disposed at the center, a press motion curve of a mechanical press having a high-speed characteristic can be obtained as shown in FIG. 4.

Figure 5:
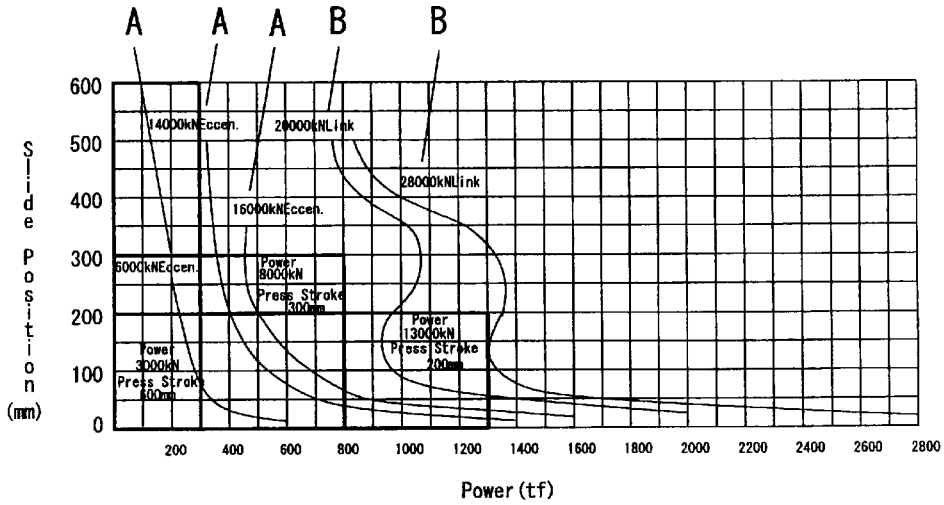
FIG. 5 is an example of a slide position-output diagram.

On the other hand, when the directional control valve 12 connected to the head side of the pressure cylinder 2 at the center is switched so as to be blocked, and, as a result, hydraulic oil is supplied to the pressure cylinders 2 on both sides, a press motion curve of a mechanical press having a large-output characteristic can be obtained as shown in FIG. 5.

Further, hydraulic oil is supplied to the accumulators 9 as much as possible, and this hydraulic oil is supplied to all of the pressure cylinders 2 through the servo valve 7 as described above, and thereby a press motion curve of a mechanical press, such as an eccentric press, a link press, or a toggle press, or a crank press which has necessary large output, can be obtained.

The position control and speed control of these pressure cylinders 2 are carried out through the slide position detector 4 in accordance with a program by which a predetermined press motion curve is set, while opening or closing the servo valve 7. As a result, it becomes possible to set a press motion curve of a mechanical press with predetermined characteristics shown in FIG. 4 and FIG. 5.

Figure 2:
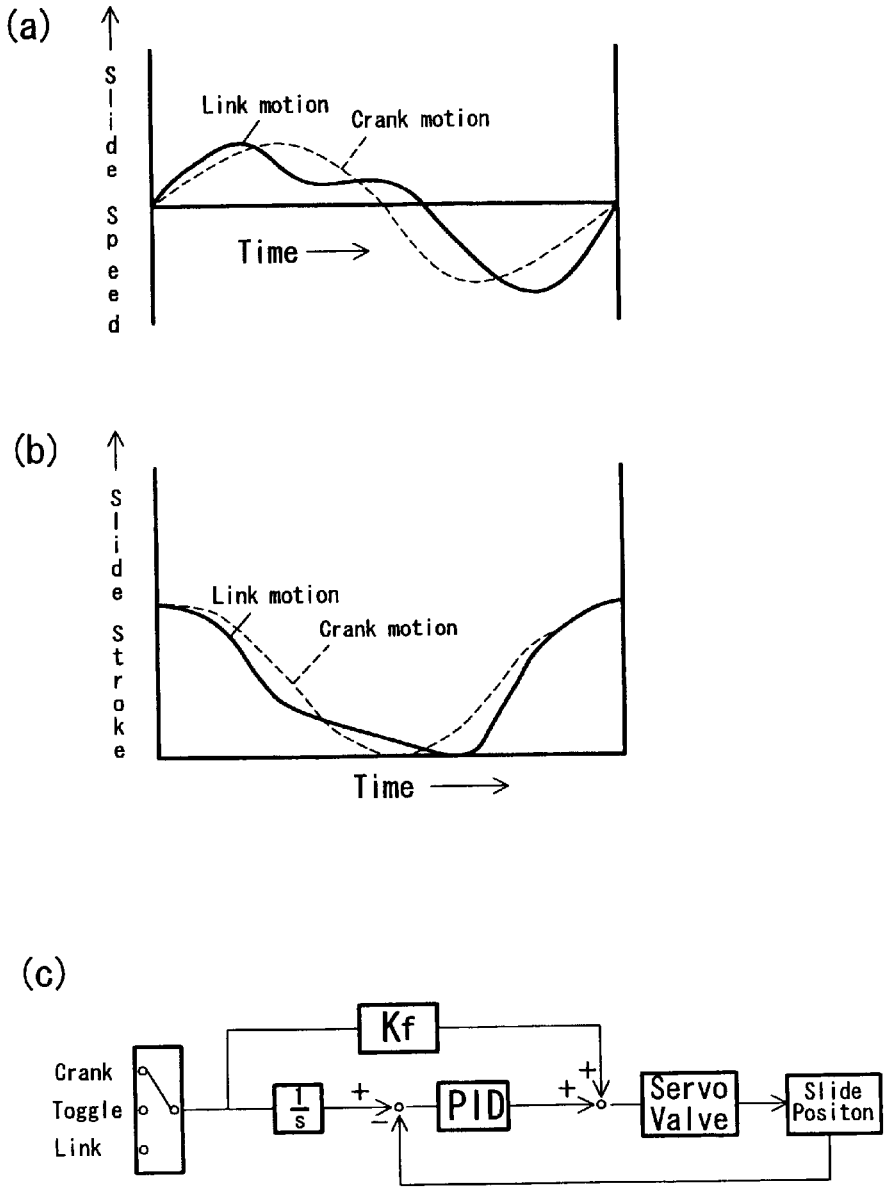
FIG. 2 (*a*) is an example of a slide speed-time diagram of a mechanical press; (*b*) is a slide stroke-time diagram, and (*c*) is a control block diagram for a hydraulic press.

As a means for setting a press motion curve, each link or lever length, crank radius, frequency, etc., of a mechanical press, such as a link press or an eccentric press, are input, and a slide speed-time diagram and a slide stroke-time diagram shown in FIGS. 2 (*a*) and (*b*) can be obtained in accordance with a well-known or published calculating formula of a press motion curve. Further, a necessary driving type of a mechanical press is selected as shown in FIG. 2(*c*), a predetermined gain Kf is then input, and a command of a slide speed is given. Thereafter, a position command is given by speed integration, and PID control is carried out to drive the servo valve 7 while feedback an actual stroke position. Thereby, the hydraulic press can match with a necessary press motion curve of the mechanical press.

Figure 3:
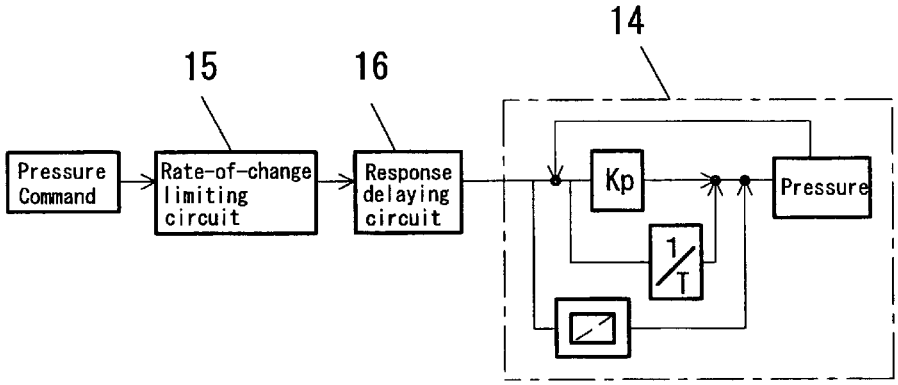
FIG. 3 is a block diagram of pressure control for the servo valve according to an embodiment of the present invention.

Main values of component of a driving portion and frequencies of the mechanical press are input in this way, and a program is arranged so that the slide 3 can follow a predetermined press motion curve. Thereafter, as shown in FIG. 3, a pressure command rate-of-change limiting circuit 15 and a pressure command response delaying circuit 16 are connected in series in front of a pressure control circuit 14 of the servo valve 7, and $P-\Delta P$ (case of pressure rising) or $P+\Delta P$ (case of pressure reduction), where P is a set value of a predetermined pressure, is given as an initial value. When the real pressure of a pressure sensor 17 of the pressure cylinder 2 reaches this value, the command value is varied continuously or in detailed stages while aiming at the set value P, so that pressure control can be carried out.

Further, by use of measurement data concerning the position of the slide of the mechanical press, an interval between the top dead center and the bottom dead center of the press motion curve is divided into, a great many of equi-divisional points so as to obtain an approximation of the press motion curve of the mechanical press. Thereafter, the slide 3 can be driven by an appropriate feedback control by the servo valve 7 through the position detector 4.

It should be noted that a required object can also be achieved by causing the interval between the start position of the pressing stroke and the lower limit position of the slide to coincide with the motion curve of the mechanical press. Accordingly, it is easy to obtain a coincidence with the motion curve of the mechanical press. What is needed in this case is to allow an approach cylinder 18 shown by the alternate long and short dash line of FIG. 1 to perform a high-speed approach to the pressing start position as in the conventional technique.

Embodiment

FIG. 1 shows the trial hydraulic press 1 whose output is 14000 kN. The pressure cylinder 2 whose output is 6000 kN is disposed at the center, and the pressure cylinders 2 each output of which is 4000 kN are disposed on both sides. These three cylinders are disposed in parallel with a predetermined stroke. The slide 3 can freely go up and down and be driven by the above-mentioned oil hydraulic circuit. The slide position-speed diagram and the slide position-output diagram of various mechanical presses, such as an eccentric press "A" and a link press "B" having output of 6000 kN to 28000 kN are shown in FIG. 4 and FIG. 5. The press motion curve with these characteristics is subjected to control by the servo valve 7 based on a position signal obtained by the position detector 4 of the slide 3 as described above. The pressure cylinder 2 at the center can output 6000 kN, and the pressure cylinders 2 on both sides can output 8000 kN (4000 kN×2), and all of the pressure cylinders 2 can output a maximum of 14000 kN.

If necessary, appropriate adjustments can be performed, for example, the pressure cylinder 2 is set at a predetermined pressure, e.g., at 3000 kN, thus obtaining 3000 kN specifications.

For example, a setting that corresponds to a mechanical press whose output is 6000 kN is performed, and the directional control valves 11 and 13 connected to the head side disposed on both sides of the pressure cylinders 2 of the oil hydraulic circuit of FIG. 1 are switched to be blocked in order to use only the pressure cylinder 2 at the center. As a result, hydraulic oil is supplied concentratively to the pressure cylinder 2 at the center, and operations for metal mold manufacturing and metal mold corrections are performed on the basis of hydraulic control and electric control that have been pre-programmed as described above.

As a result, the slide 3 of the trial hydraulic press 1 according to this embodiment is moved along the slide position-speed line of the mechanical press of FIG. 4 and FIG. 5 so as to mold or correct the metal mold, and this can be used for the mechanical press as it is.

Even if the pressure onto the pressure cylinder 2 is set at 3000 kN, the same operations as above can be performed. Further, even if the pressure cylinder 2 at the center is blocked so as to supply hydraulic oil to the pressure cylinders 2 on both sides, the same operations as above can be performed.

It is also possible to fill hydraulic oil in the accumulators 9 as much as possible, and to supply this hydraulic oil to all of the pressure cylinders 2 through the servo valve 7, and thereby to obtain a required speed of the mechanical press.

As described above, the slide can be moved along the motion curve of a mechanical press, such an eccentric press, a link press, a toggle press, a crank press, or a combination of these presses, in accordance with a required output tonnage, and metal molds of various mechanical presses used in each field can be easily manufactured or corrected. Additionally, in the case of high tensile steels or aluminum materials that are particularly difficult to mold, metal mold manufacturing and metal mold corrections can be easily carried out for the mechanical press.

The number of pressure cylinders of a hydraulic press can be determined in conformity with the spirit of the present invention as mentioned above, and it is preferable to select a press in which an odd number of pressure cylinders (e.g., five or seven pressure cylinders) are disposed axisymmetrically as above.

What is claimed is:

1. A hydraulic control method for a hydraulic press in which a plurality of pressure cylinders are disposed along an axis of a slide of the hydraulic press, individual ones the pressure cylinders being capable of being selectively pressurized under control of a servo valve so that a press motion curve of the hydraulic press can be made to match press motion curves of a plurality of different mechanical presses when making metal molds, the method comprising the steps of:

accumulating hydraulic oil in an accumulator, the oil capable of being transmitted by a pump unit to any one of the plurality of pressure cylinders under the control of the servo valve;

selectively opening a directional valve associated with each one of the pressure cylinders to be selectively pressurized so that different predetermined amounts of oil can be supplied to each one of the pressure cylinders to be pressurized; and controlling a position and speed of the slide of the hydraulic press by the servo valve, the servo valve operating based on a first input determined by a predetermined one of the plurality of different mechanical presses to be matched and a second input from a slide position detector, the second input providing an actual position of the slide of the hydraulic press, wherein the controlling step makes it possible to match the press motion curve of the hydraulic press with the press motion curve of any of the plurality of different mechanical presses.

2. The hydraulic control method for a hydraulic press of claim 1, wherein the directional control valve of the pressure cylinder disposed at a center of the plurality of pressure cylinders is opened and supplied with the hydraulic oil and others of the directional control valves remain closed.

3. The hydraulic control method for a hydraulic press of claim 1, wherein the directional control valves of all of the pressure cylinders are opened concurrently to supply hydraulic oil to all of the corresponding pressure cylinders.

4. The hydraulic control method for a hydraulic press of claim 1, further comprising the step of matching the press motion curve of the predetermined mechanical press in a range from an upper limit position of a closing stroke of the slide of the hydraulic press to a lower limit position thereof.

5. The hydraulic control method for a hydraulic press of claim 1, further comprising the step of matching the press motion curve of the predetermined mechanical press in a range from a start position of a pressing stroke of the slide of the hydraulic press to a lower limit position thereof.

6. The hydraulic control method for a hydraulic press of claim 5, wherein materials for the metal molds are high tensile steels or aluminum materials.

7. The hydraulic control method for a hydraulic press of claim 5, wherein one or more of the pressure cylinders are subjected to hydraulic control by the servo valve on the basis of the press motion curve of the predetermined mechanical press so that a speed of the slide of the hydraulic press matches a speed of a slide of the predetermined mechanical press as each of the slides move.

8. The hydraulic control method for a hydraulic press of claim 5, wherein the mechanical press is an eccentric press, a link press, a toggle press, a crank press, or a combination of these presses.

9. The hydraulic control method for a hydraulic press of claim 1, wherein materials for the metal molds are high tensile steels or aluminum materials.

10. The hydraulic control method for a hydraulic press of claim 1, wherein the directional control valves of the pressure cylinders at opposite ends of the slide of the hydraulic press are opened concurrently and so as to be concurrently supplied with the hydraulic oil.

* * * * *